United States Patent [19]

Marsh

[11] Patent Number: 4,679,955

[45] Date of Patent: Jul. 14, 1987

[54] DOCUMENT HOLDER

[76] Inventor: Jesse Marsh, Viale Romagna 56/3, 20133 Milan, Italy

[21] Appl. No.: 857,475

[22] Filed: Apr. 30, 1986

Related U.S. Application Data

[62] Division of Ser. No. 744,950, Jun. 17, 1985.

[51] Int. Cl.[4] ..... B42F 3/00; B42F 13/00; B42F 15/00; B42D 15/00

[52] U.S. Cl. ..... 402/4; 283/74; 24/67.11; 312/184

[58] Field of Search ..... 402/15, 19, 22, 4, 74, 402/73, 66; 283/74; 312/183, 184, 185, 189; 24/67.11, 108; 40/202

[56] References Cited

U.S. PATENT DOCUMENTS

| | | | |
|---|---|---|---|
| 1,938,878 | 12/1933 | Blankenstein | 24/108 |
| 1,964,002 | 6/1934 | Lester | 283/74 |
| 3,684,340 | 8/1972 | Kirkorian | 312/184 |
| 4,192,620 | 3/1980 | Jahn | 402/15 |
| 4,256,411 | 3/1981 | Podosek | 402/15 |
| 4,525,899 | 7/1985 | Carrol | 24/67.11 |

*Primary Examiner*—E. R. Kazenske
*Assistant Examiner*—Paul M. Heyrana
*Attorney, Agent, or Firm*—Raphael Semmes

[57] ABSTRACT

A document holder for an assembly of loose leaf sheets, such as computer printouts, including a channel member provided with a slot defining a track for slidably and separably receiving at least one binder element secured to the sheet assembly, wherein the binder element is detachably snapfitted to the sheet assembly through aligned apertures formed in corresponding perforated margin portions of the sheets.

4 Claims, 4 Drawing Figures

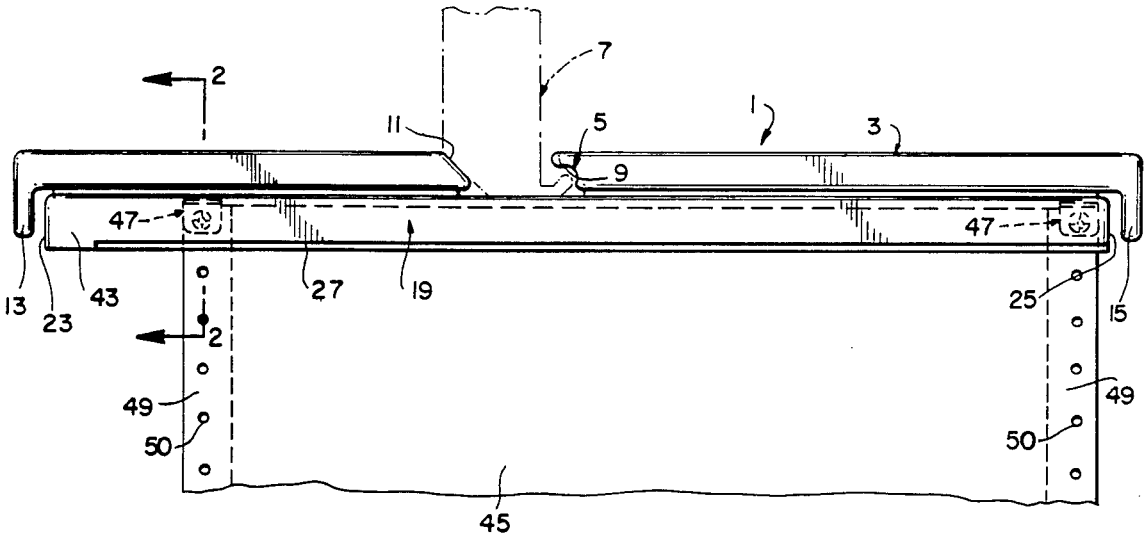
FIG 1
FIG 3
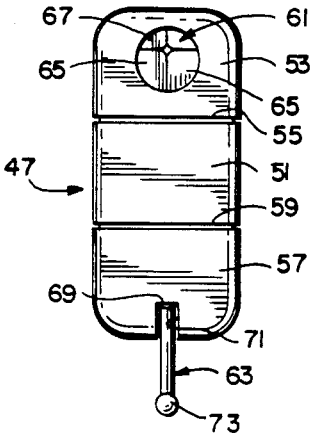
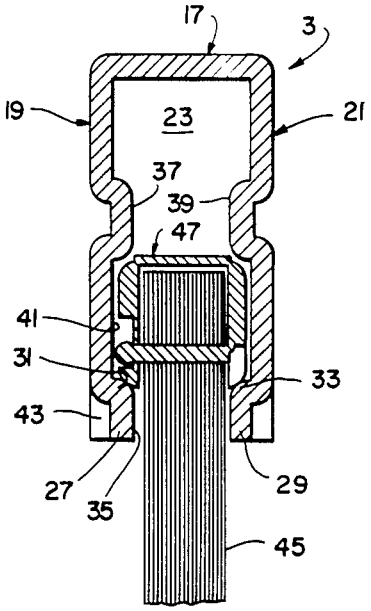
FIG 2
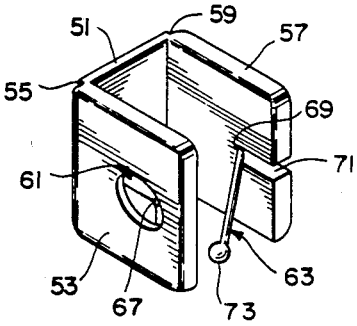
FIG 4

DOCUMENT HOLDER

This application is a division of application Ser. No. 744,950 filed June 17, 1985.

BACKGROUND OF THE INVENTION

1. Field of the Invention

The present invention generally involves the field of technology pertaining to devices for securing a plurality of looseleaf sheets together. More specifically, the invention relates to an improved holder for securing an assembly of sheets together and supporting the sheet assembly in a suspension filing system.

2. Description of the Prior Art

The field of prior art pertaining to devices for securing looseleaf sheets together is quite active and crowded. A specific area in this field pertains to devices for securing assembled sheets having aligned apertures, such as computer printout sheets or other such documents utilized in data processing. Since computer printout sheets are almost a necessity in the conduct of most businesses, it is therefore critical that bound volumes of such sheets be efficiently stored and made readily available for reference purposes when needed.

More recently, document holders designed specifically for securing and storing computer printout sheets have generally been in the form of a binder for the sheets and provided with means for supporting the binder in a suspension filing system, commonly of the type comprising either a single central support hanger or a pair of side support rails. However, conventional binders for this purpose have generally been more complex in configuration, expensive to manufacture and difficult to use. Some examples of known binders for looseleaf sheets, and particularly binders for computer printout sheets, are disclosed by the Lawson U.S. Pat. No. 742,419; Ivory et al U.S. Pat. No. 3,285,251; Kirkorian U.S. Pat. No. 3,684,340; Frank U.S. Pat. No. 3,748,051; Wright et al U.S. Pat. No. 3,980,360; Hedstrom et al U.S. Pat. No. 4,046,296; Hedstrom et al U.S. Pat. No. 4,171,854; and Hedstrom et al U.S. Pat. No. 4,285,555.

SUMMARY OF THE INVENTION

It is an object of the present invention to provide an improved document holder for looseleaf sheets.

It is another object of the invention to provide an improved document holder for computer printout sheets whereby such sheets may be easily secured together and stored for future reference.

It is a further object of the invention to provide an improved document holder that is simple in construction and economical to manufacture.

It is yet another object of the invention to provide an improved binder element for securing together an assembly of sheets having aligned perforations, wherein the binder element is easily attached to and detached from the sheet assembly and serves to maintain the sheets in their assembled condition.

These and other objects of the invention are realized by providing an improved document holder including an elongate channel member provided with a track for slidably and separably receiving at least one binder element thereon. The holder is preferably utilized for securing and supporting an assembly of computer printout sheets in a conventional suspension filing system, in which use a pair of binder elements are employed for detachable snapfit engagement through the uppermost aligned apertures in the corresponding perforated margin portions on both sides of the sheet assembly. The binder element includes a base section and a pair of side sections extending outwardly from opposite sides of the base section, with one side section including a pivotal shank provided with an enlarged portion at its free end, and the other side section including an expandable opening for snapfitting over the enlarged portion of the shank. The sheet assembly and associated binder elements are then attached to the channel member by sliding the binder elements and associated edge portion of the sheet assembly through an enlarged opening at one end of the channel member and onto the track, the latter being defined by a pair of inwardly directed longitudinal edges of the channel member.

The foregoing and other objects and advantages of the invention shall become apparent from the following detailed description of a preferred embodiment thereof, when considered in conjunction with the drawings, wherein like reference characters designate corresponding parts in the several views.

BRIEF DESCRIPTION OF THE DRAWINGS

FIG. 1 is a front elevational view, partly broken away, of a document holder in accordance with a preferred embodiment of the invention and shown supporting an assembly of computer printout sheets in a suspension filing system;

FIG. 2 is a cross-sectional view taken on the line 2—2 of FIG. 1;

FIG. 3 is a top view of a binder element forming a part of the document holder of FIG. 1, shown in an unfolded position; and FIG. 4 is a perspective view of the binder element of Fig. 3, shown in a folded position.

DETAILED DESCRIPTION OF THE PREFERRED EMBODIMENT

A document holder 1, in accordance with a preferred embodiment of the invention, shall now be described with initial reference to FIG. 1. As shown therein, holder 1 includes an elongate channel member 3 provided with a hook section 5 for detachably supporting channel member 3 from a single support hanger, shown generally at 7, of a conventional suspension filing system. The configuration of hook section 5 is also conventional and defined by a hooked tab 9 and an opposed inclined wall section 11. As further shown in FIG. 1, the outer ends of channel member 3 may also be provided with opposed end hook sections 13 and 15 when holder 1 is utilized with a conventional filing system having a pair of side rails.

With reference now to FIG. 2, the transverse cross-sectional configuration of channel member 3 defined by a top wall 17, a pair of spaced downwardly depending side walls 19 and 21, and a pair of end walls 23 and 25, with end wall 25 being shown in side view in FIG. 1. Side walls 19 and 21 terminate in a pair of free edges 27 and 29 which are disposed inwardly of the general spacing between side walls 19 and 21 to form an internal track defined by a pair of opposed longitudinal ledges 31 and 33. It is also apparent that free edges 27 and 29 serve to define a slot 35 having a width corresponding to the spacing between the inner surfaces of free edges 27 and 29 extending up to ledges 31 and 33. A pair of inwardly directed opposed longitudinal ribs 37 and 39 may also be provided, wherein the spacing between the internal surfaces of ribs 37 and 39 is preferably the same as the spacing between the internal surfaces of free edges 27 and 29. By virtue of the aforedescribed configuration, a longitudinal compartment 41 is therefore formed, the upper end of which compartment 41 being defined by ribs 37 and 39, and the lower end of which compartment 41 is defined by ledges 31 and 33. As more clearly shown in FIG. 1, the inwardly disposed portions of free edges 27 and 29 extend for substantially the entire length of channel member 3, but terminate short of end wall 23, thereby defining an enlarged portion 43, which portion 43 encompasses end wall 23. The spacing between the internal surfaces of enlarged portion 23 is substantially the same as that for side walls 19 and 21.

As also depicted in FIGS. 1 and 2, an assembly 45 of computer printout sheets is supported within compartment 41 of channel member 3 by a pair of binder elements 47, the structural details of which shall be later described. Sheet assembly 45 is well known in the art and comprises a plurality of loose or folded sheets having opposed perforated margin portions 49, with each margin portion 49 being provided with a plurality of apertures 50 that are alignable with corresponding apertures 50 of adjacent sheets. When assembled, sheet assembly 45 and associated binder elements 47 are disposed within longitudinal compartment 41 of channel member 3 by sliding the upper edge of assembly 45 and binder elements 47 through enlarged portion 43 of channel member 3. As particularly seen in FIG. 2, sheet assembly 45 is retained within compartment 41 because the outer portions of binder elements 47 are supported on longitudinal edges 31 and 33. In this respect, it is preferred that the cross-sectional configuration of binder elements 47 conform substantially to the cross-sectional configuration of compartment 41, as shown in FIG. 2. Removal of sheet assembly 45 from channel member 3 is accomplished in the reverse manner by simply sliding sheet assembly 45 towards end wall 23 so that binder elements 47 may be pulled through enlarged portion 43. In this respect, it is of course preferred that the length of enlarged portion 43, as viewed in FIG. 1, be slightly longer than the length of each binder element 47 in order that the latter may freely drop through enlarged portion 43 after it has cleared ledges 31 and 33.

The structural details of binder element 47 and the manner in which it is utilized to secure sheet assembly 45 together shall now be described with particular reference to FIGS. 3 and 4. Element 47 is essentially defined by a base section 51 provided with a first side section 53 hinged along one side thereof at a hinge line 55, and a second side section 57 hinged along an opposed side thereof at a hinge line 59. Sections 51, 53 and 57 are preferably of substantially the same size and configuration, and integrally formed of an appropriate plastic material, such as polypropylene. Hinge lines 55 and 59 comprise thin, relatively flexible hinges. Sections 51, 53 and 57 are thicker and relatively inflexible. Element 47 is provided with a snapfit locking means that includes an expandable aperture 61 formed in first side section 53 and a shank 63 pivotally carried by second side section 57. Expandable aperture 61 is substantially circular in configuration and defined by a plurality of individual segments 65 which may be deformed outwardly upon application of pressure thereto. Segments 65 converge inwardly and terminate to form an opening 67 which is substantially circular and of the same diameter as shank 63. Shank 63 is hinged at one end, by thin, relatively flexible hinge 69, to the base of a slot 71 formed in second side section 57. The free end of shank 63 is provided with an enlarged portion 73.

It is apparent from the aforedescribed construction of binder element 47 that it is therefore capable of being folded along hinge lines 55 and 59 from the unfolded flat configuration shown in FIG. 3 to the folded configuration shown in FIG. 4, with first and second side sections 53 and 57 being pivoted inwardly towards each other so that hinge 69 of shank 63 is positioned directly opposite opening 67 of expandable aperture 61.

Sheet assembly 45 is secured together with a pair of binder elements 47 by inserting shank 63 of each element 47 through the uppermost aligned perforations 50 of each margin portion 49. Base section 51 and first side section 53 are then folded down over and onto, respectively, the corresponding edge and opposed surface of assembly 45. Removal of each binder element 47 from sheet assembly 45 is accomplished in the reverse procedure whereby first side section 53 is snapped off enlarged portion 73 of shank 63, followed by the subsequent withdrawal of shank 63 from its aligned perforations 50.

It is to be understood that the embodiment of the invention herein shown and described is to be taken as a preferred example of the same, and that various changes in the shape, size, arrangement of parts and applications may be resorted to, without departing from the spirit of the invention or scope of the subjoined claims.

I claim:

1. A binder element for securing an assembly of sheets provided with alignable apertures, said binder element being adapted to be received in a longitudinal compartment provided by a channel member, said compartment having a particular cross-sectional configuration, which element comprises:

(a) a base section disposable adjacent an edge of the sheet assembly;

(b) first and second side sections extending from and hingedly secured to opposite sides of the base section by relatively thin, flexible hinge means for folding onto opposed sides of the sheet assembly;

(c) a shank pivotally secured to the first side section by relatively, thin flexible hinge means for insertion through the aligned apertures of the sheet assembly; and (d) means carried by the second side section for detachable engagement with the shank to secure the element to the sheet assembly, said binder element, when said shank is engaged with said means for detachable engagement, conforming substantially to said cross-sectional configuration of said compartment.

2. The binder element of claim 1 wherein the shank includes a free end provided with an enlarged portion and the detachable engagement means includes an expandable aperture defined by a plurality of deformable segments.

3. The binder element of claim 1 wherein the entire element is integrally formed of plastic material.

4. The binder element of claim 1, wherein said base section, said first side section and said second side section are of substantially the same size and configuration.

* * * * *